United States Patent [19]

Waters, Jr.

[11] Patent Number: 4,480,839

[45] Date of Patent: Nov. 6, 1984

[54] BOARD BLOCKS WITH PIECES MOVED BY INTERCONNECTED END BLOCKS

[76] Inventor: James B. Waters, Jr., 346 Summit Ave. Apt. 202, Gaithersburg, Md. 20877

[21] Appl. No.: 396,493

[22] Filed: Jul. 8, 1982

[51] Int. Cl.[3] ..... A63F 3/00; A63F 9/14

[52] U.S. Cl. ..... 273/258; 273/287

[58] Field of Search ..... 273/153 S, 258, 271, 273/287

[56] References Cited

U.S. PATENT DOCUMENTS

| | | | |
|---|---|---|---|
| 1,144,743 | 6/1915 | Upjohn | 273/258 |
| 2,982,551 | 5/1961 | Garnett | 273/258 |
| 3,747,932 | 7/1973 | Grissino | 273/248 |
| 4,210,337 | 7/1980 | Obermair | 273/264 |
| 4,303,246 | 12/1981 | Strongin | 273/271 |
| 4,402,510 | 9/1983 | Yokoi | 273/153 S |

*Primary Examiner*—Richard C. Pinkham
*Assistant Examiner*—Scott L. Brown
*Attorney, Agent, or Firm*—Quaintance & Murphy

[57] ABSTRACT

A game board with a base having four raised corner platforms defining a cross shaped playing surface therebetween, upon the base. Four player positions are thus defined on the four sides of the game but the game may be played by two, three or four players. Game pieces include from one to four marked pieces for each player and a predetermined plurality of total game pieces, including neutral, unmarked pieces and the marked pieces. Pairs of player moved, interconnected end blocks are arrayed side by side on the base with pieces aligned in a row between connected end blocks. Rows thus defined are movable at a 90 degree angle with rows arrayed therethrough and thereacross. Each game piece is radiused at its corners to facilitate movement of pieces past each other. Each player begins with one or marked pieces in a home position, the object of the game being to move such pieces across the board to the home position of another player.

10 Claims, 10 Drawing Figures

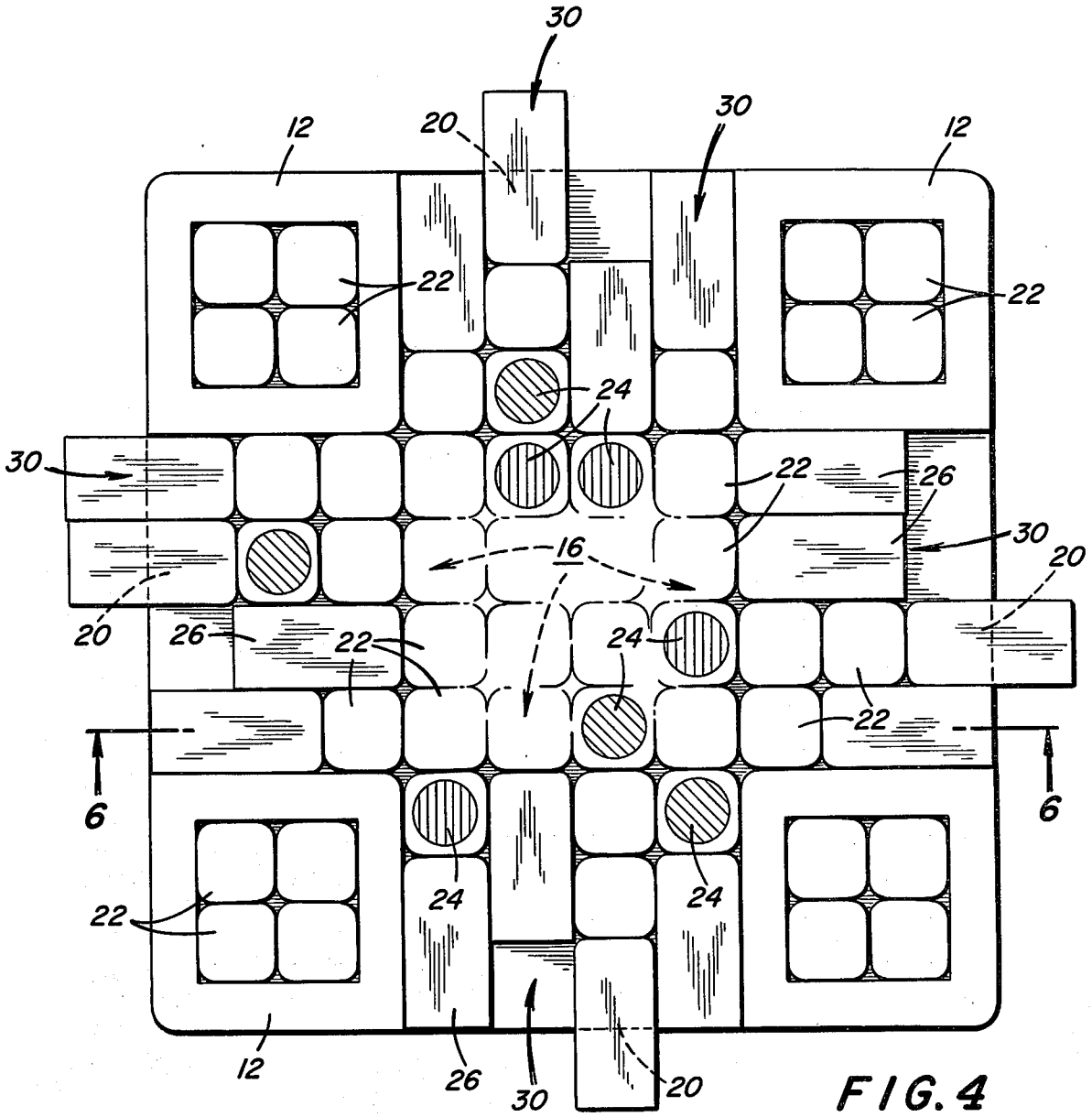
FIG. 4
FIG. 5A
WHEN X=3
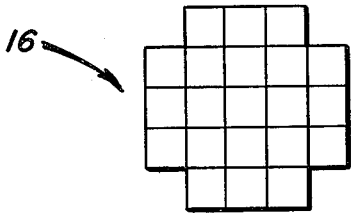
$X^2+4X=21$
FIG. 5B
WHEN X=5
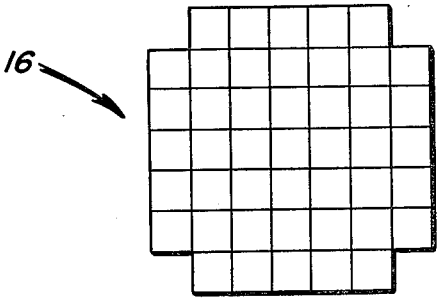
$X^2+4X=45$

BOARD BLOCKS WITH PIECES MOVED BY INTERCONNECTED END BLOCKS

BACKGROUND OF THE INVENTION

This invention relates generally to game board assemblies and games played thereupon and more particularly to an improved game board having a plurality of pieces moved thereacross from a "home" position to a "game over" position, the game providing enhanced intellectual stimulation and enjoyment for the players.

The prior art does disclose a variety of games wherein game pieces of one variety or another are moved from a first or "home" position to a "game over" position, somewhere else on the board, usually in an opponent's home position. Chinese Checkers is a classic example of the general concept. U.S. Pat. No. 3,731,934 issued to P. L. Shoptaugh on May 8, 1973, discloses a game board apparatus including laterally slidable members with barriers thereon, the idea of the game being to move spheres or marbles from one side of the board to the other to complete the game. The idea of the game, of course, is to complete the transfer of the pieces before the opponent transfers his pieces across the board. A generally cross shaped playing surface having no movable parts is disclosed in U.S. Pat. No. 3,116,928 issued to H. P. Wilde, Sr. Another somewhat related game involving spheres movable to a trapped position and played in a single plane is disclosed in U.S. Pat. No. 3,706,457 issued to N. Gonzales, et al, on Dec. 19, 1972.

However, the prior art does not disclose a game board having a base with raised corner platforms to define a cross shaped playing surface therebetween, and a predetermined number of game pieces thereon, a variable number of which may be marked, the game being playable by from two to four players and wherein selected marked pieces start in a home position and then are movable forwardly and laterally across the game board to an opponent's home position, whereupon the first player wins the game, or has moved his pieces to a "game over" position.

SUMMARY OF THE INVENTION

Accordingly, it is a principal object of the invention to provide a game board having a cross shaped surface defined thereon which is filled by a predetermined number of linearly and laterally movable game pieces, certain of the pieces being marked and transferable from a "home" position to a "game over" position, the game being playable by 2, 3, or 4 persons with a variable, predetermined number of marked pieces.

It is another object of the invention to provide a game board apparatus having a cross shaped playing surface thereon filled by a number of playing pieces, linear rows of such pieces being embraced by end members connected to one another beneath the game pieces, linear rows of such pieces being arrayed with other linear rows at 90 degrees thereto but in the same plane, the rows being shiftable linearly and laterally to thus move a game piece or pieces across the playing surface, linearly and laterally.

It is yet another object of the invention to provide a game board apparatus having a cross shaped playing surface thereon, filled by a predetermined number of substantially identical, linearly and laterally movable game pieces, the total number of game pieces being determined by the formula $x^2+4x$, thus providing a substantial number of games of varying complexity, all of which may be based upon the broad principle as just stated.

It is a further object of the invention to provide a game board apparatus upon which a board game may be played having an intriquing variety of ways in which a particular game may be played, thus to enhance intellectual stimulation and enjoyment for the players.

Generally speaking, the game board apparatus invention herein disclosed and claimed includes a base with four raised corner platforms which thereby define a cross shaped surface therebetween, upon the base, and four player positions on each of the four sides of the game, the game being playable by two, three or four players, the playing surface just defined including a first, central, generally square shaped playing surface and four playing surface extensions located on the four sides of the first surface, between adjacent pairs of the four corner platforms, a plurality of substantially square, identical, movable game pieces, the total number of the playing pieces being determined by the formula $x^2+4x$, the quantity x being the number 2 or a greater whole number and the $x^2$ quantity of pieces being located, initially, in the first surface with the 4x quantity of pieces located in the playing surface extensions, a predetermined quantity of the game pieces being marked, and linear adjacent rows of the playing pieces being embraced by end blocks, pairs of end blocks across from one another embracing pieces therebetween, the end blocks being interconnected beneath the game pieces, rows of such pieces in one direction being interfitted with rows of such pieces at right angles thereto whereby game pieces may be moved laterally and linearly across the playing surface to thereby play a game.

Further novel features and other objects of this invention will become apparent from the following detailed description, discussion and the appended claims taken in conjunction with the accompanying drawings.

BRIEF DESCRIPTION OF THE DRAWINGS

Preferred structural embodiments of this invention are disclosed in the accompanying drawings in which:

FIG. 4 is a top, plan view of the invention as shown in FIG. 2 but showing pieces arranged during playing of a game;

FIGS. 5A and 5B are schematic plan views of optional game boards according to this invention, x being the whole number 3 in FIG. 5A and 5 in FIG. 5B;

Figure 1:
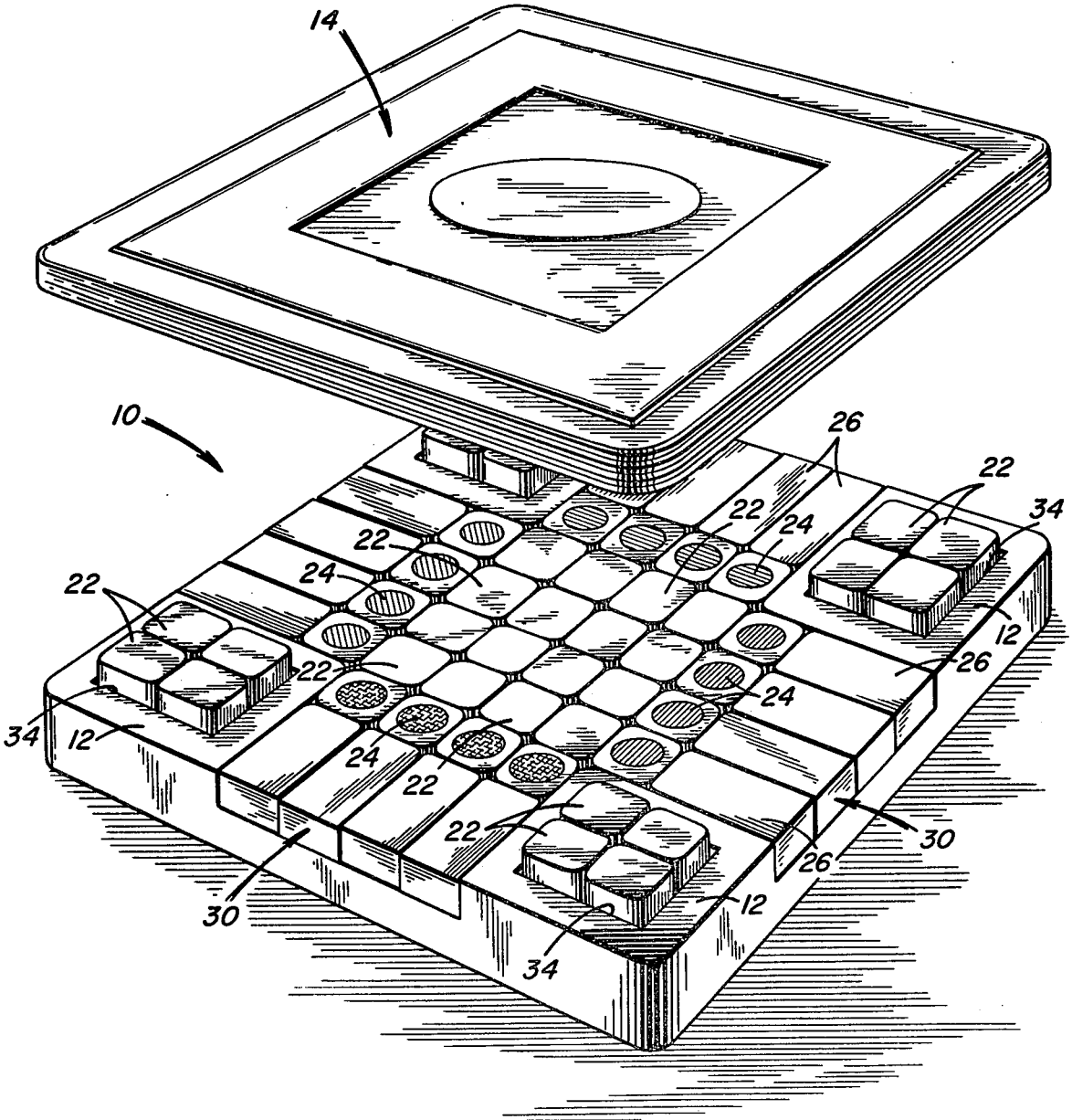
FIG. 1 is a top perspective view of the invention and also showing a cover therefor for use when the game is stored away.
Figure 2:
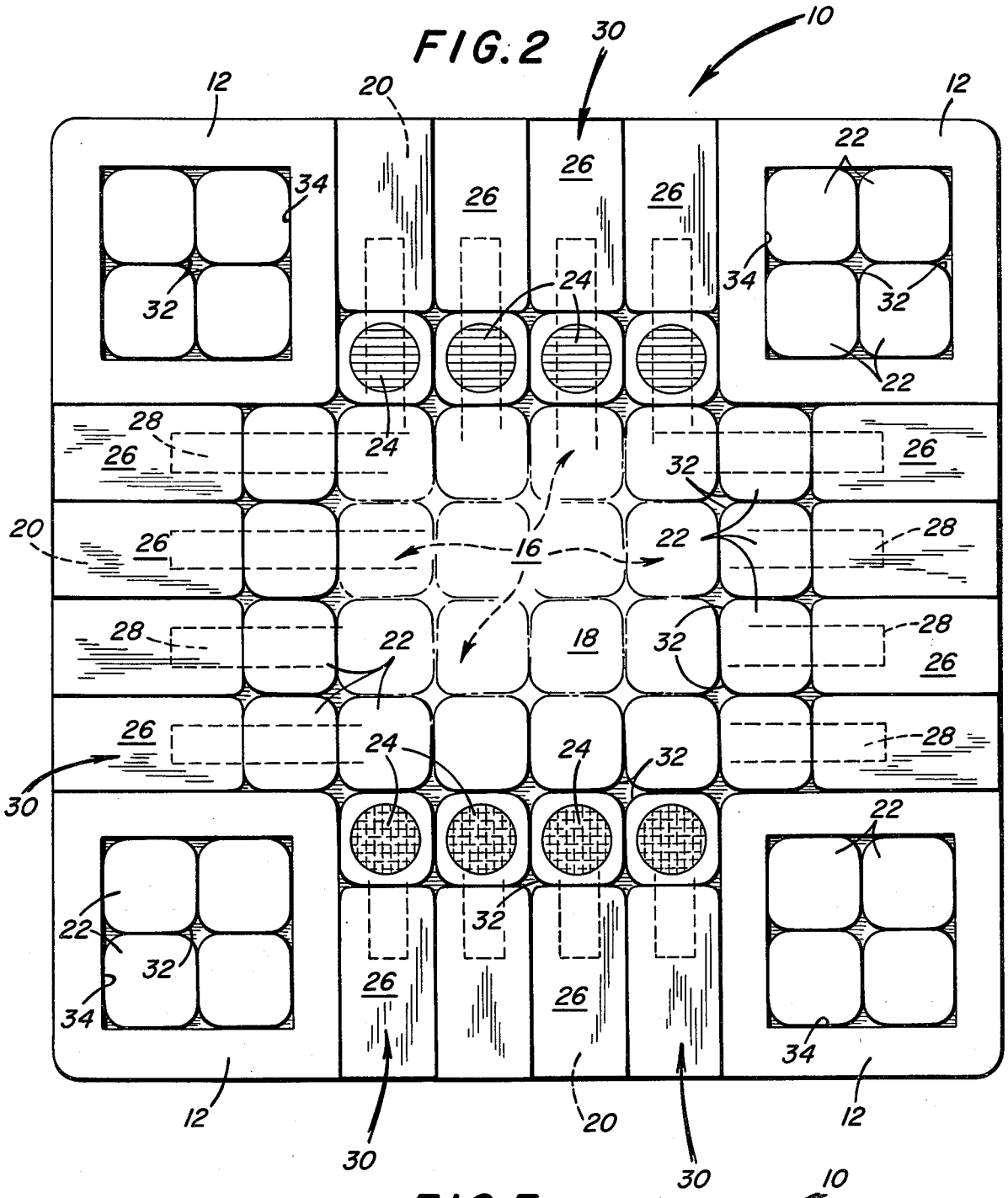
FIG. 2 is a top plan of the invention as illustrated in FIG. 1 illustrating a starting mode for playing the game, the game being arranged for play by two players.
Figure 3:
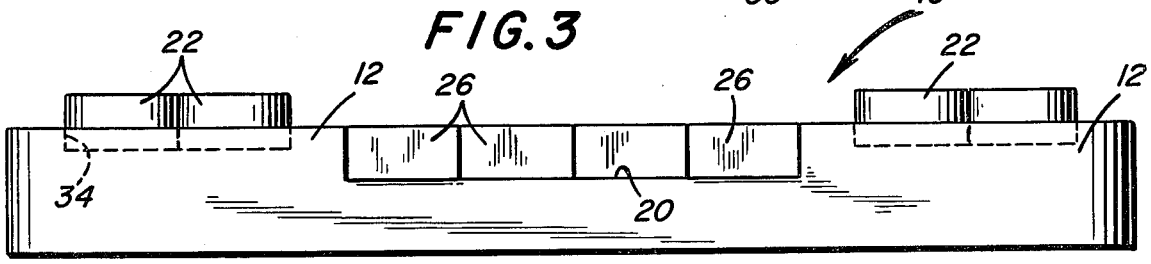
FIG. 3 is a side or end elevation view of the invention as shown in FIG. 2.
Figure 6:
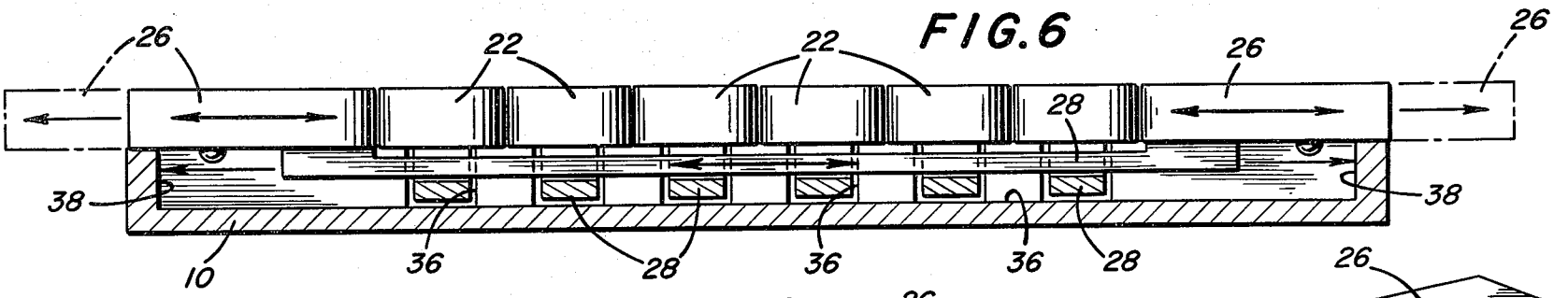
FIG. 6 is a section view taken along lines 6—6 of FIG. 2.
Figure 7:
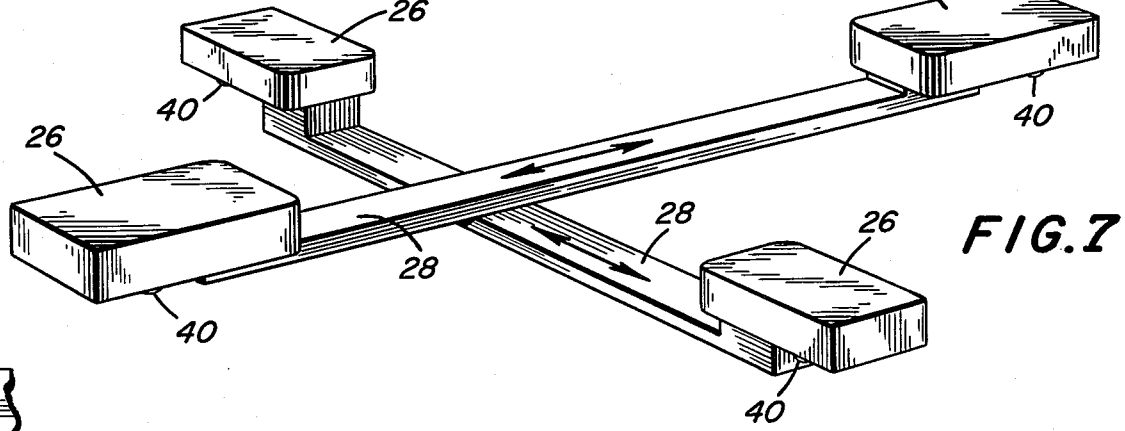
FIG. 7 is a perspective view of two pairs of end blocks of the game at right angles to each other, game pieces therebetween being removed for purposes of clarity.
Figure 9:
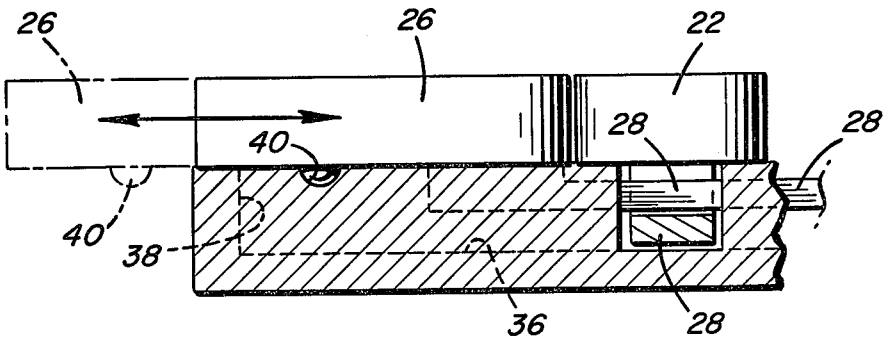
FIG. 9 is a fragmentary elevation section view of an end block in place on the game board.
Figure 8:
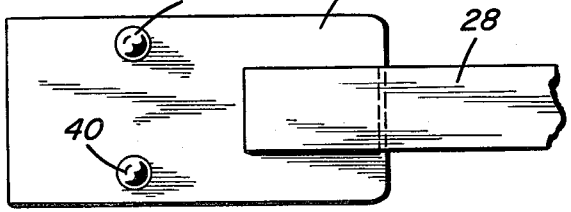
FIG. 8 is a fragmentary, bottom plan view of one end block of the invention.